US007051697B2

(12) United States Patent
Waelput

(10) Patent No.: US 7,051,697 B2
(45) Date of Patent: May 30, 2006

(54) IC ENGINE FLUSHING SYSTEM WITH SPECIALIZED ADAPTERS FOR COUPLING THE SYSTEM TO DIFFERENT OIL FLOW PORTS OF THE ENGINE

(76) Inventor: Erik F. Waelput, 16615 So. Pacific, Sunset Beach, CA (US) 90742

( * ) Notice: Subject to any disclaimer, the term of this patent is extended or adjusted under 35 U.S.C. 154(b) by 95 days.

(21) Appl. No.: 10/423,340

(22) Filed: Apr. 25, 2003

(65) Prior Publication Data

Related U.S. Application Data

(63) Continuation of application No. PCT/US01/51401, filed on Oct. 24, 2001.

(60) Provisional application No. 60/243,879, filed on Oct. 26, 2000.

(51) Int. Cl.
*F16N 33/00* (2006.01)

(52) U.S. Cl. ..... 123/196 A; 134/169 A

(58) Field of Classification Search ..... 123/196 A, 123/196 S, 196 R, 198 A; 134/169 A; 184/1.5, 184/54, 57
See application file for complete search history.

(56) References Cited

U.S. PATENT DOCUMENTS 4,746,149 A * 5/1988 Thompson ..... 285/148.13
5,005,875 A * 4/1991 Harle ..... 285/73
5,063,896 A * 11/1991 Hyatt et al. ..... 123/198 A
5,474,098 A * 12/1995 Grigorian et al. ..... 134/169 A
6,089,205 A * 7/2000 Grigorian et al. ..... 123/196 A

* cited by examiner

*Primary Examiner*—Henry C. Yuen
*Assistant Examiner*—Hyder Ali

(57) ABSTRACT

An adapter system for use with an internal combustion engine flushing apparatus which permits connection to the crankcase and to the oil filter of internal combustion engines. A first adapter assembly enables a conduit hose of a flushing apparatus to be connected with the drain plug port of the engine crankcase via a specialized adapter piece and a universal adapter piece. The uniform adapter piece forms a threaded connection with the specialized adapter piece for attachment to the conduit hose of the flushing apparatus. A second adapter assembly for coupling a second hose of the flushing apparatus also includes one of a plurality of specialized adapter elements selected to fit the oil filter port of a particular automobile engine and a universal adapter element connected by a bayonet coupling between the specialized adapter and a second conduit hose of the flushing apparatus.

29 Claims, 4 Drawing Sheets

IC ENGINE FLUSHING SYSTEM WITH SPECIALIZED ADAPTERS FOR COUPLING THE SYSTEM TO DIFFERENT OIL FLOW PORTS OF THE ENGINE

This application is a continuation of PCT Application No. PCT/US01/51401 filed Oct. 24, 2001, the priority date for which is Oct. 26, 2000, the filing date of Provisional Application Ser. No. 60/243,879.

The present invention generally relates to systems and apparatus for cleaning internal combustion engines and, more particularly, to the assemblies which have been devised to couple such systems to oil ports of the engine so that the cleaning solutions can be pumped into and out of the engine.

Through use, internal combustion engines develop buildup of deposits, sludge and the like in the passages through which oil flows for lubrication. This occurs to at least some extent, despite the presence and frequent replacement of oil filters installed on the engines. A considerable number of prior art patents disclose systems and arrangements designed to alleviate this problem. In general, such systems include conduits for coupling to oil ports of the engine, one at the oil filter port for directing the cleaning solution into the engine and another for coupling to the crankcase drain port to receive the cleaning solution from the engine.

Such systems generally comprise a reservoir for storing the cleaning solution, a pump for driving the solution through the engine and returning it to the reservoir and various controls for automating the procedure. Three such patents of which I am a named inventor are U.S. Pat. No. 5,168,844, entitled ADAPTER SYSTEM FOR USE WITH AN INTERNAL COMBUSTION ENGINE FLUSHING APPARATUS; U.S. Pat. No. 5,383,481, entitled SYSTEM FOR CLEANING INTERNAL COMBUSTION ENGINES; and U.S. Pat. No. 5,467,746, entitled ADAPTERS FOR FLUSHING AN INTERNAL COMBUSTION ENGINE. These patents in their entirety are incorporated herein by reference.

I have found that there are certain drawbacks and disadvantages with respect to the conduit coupling devices of the systems of those patents and I have made certain improvements which are the subject of the present invention.

In the system of my '746 patent one drain plug port adapter is specially formed for each different model of automobile engine and is intended to be installed permanently in place. Also, with the oil pans of certain automobile engines, it is extremely difficult to install the drain plug port adapter.

Similarly with respect to the oil filter port adapters of prior art systems, it is frequently the case that the adapter may be awkward to attach, because of the various inconvenient or relatively inaccessible placement of the oil filter base plate. Also, the oil filter port adapter may be difficult to remove as a result of the different fittings which are employed. These fittings must necessarily be tightly coupled to the oil filter base plate to prevent leaks at the adapter location. On occasion, these become difficult to remove because different portions of the fittings are threaded differently and tend to bind when efforts are made to remove them.

In brief, particular arrangements of the present invention provide an adapter assembly for coupling to the drain plug port of the oil pan which consists of two major components. The first is a specialized fitting having a threaded portion which mates with the threaded opening in the drain plug port. Since the threaded portions of the drain plugs and the drain plug port may differ substantially from car to car, both in size of opening and coarseness of threads, my arrangement provides a plurality of such specialized adapters to fit all of the various automobile engine models known.

Each such component terminates in an internal threaded bore which is universal. This is designed to accept a universal component for attachment to the flexible conduit leading to the pump and reservoir of the system. Thus, this first adapter assembly is much simpler in construction, easier to use, and calls for a substantially reduced inventory of component parts than known prior art units. Moreover, there is no need for permanent installation of an adapter element in the crankcase drain plug port.

In accordance with another aspect of the invention, I provide a coupling for connection to the oil filter base plate port which achieves corresponding simplicity of components, ease of installation, and uniform adaptability to various types of oil filter base plates. This second adapter assembly comprises a specialized adapter element having an internal threaded bore with sizes and thread dimensions adapted to fit a particular automobile engine. The bores of these specialized adapters commonly are provided in inch sizes of ⅜, ½, ⅝, ¾, ⅞ and in metric to 30 or 32 mm. Each of these specially configured adapter elements is fitted with a pair of bayonet lugs on its outer circumference about the end which is remote from the oil filter base plate.

A universal adapter element is configured with internal slots adapted to receive the bayonet lugs of the specialized adapter element for ultimate connection to a second flexible conduit that brings cleaning solution from the pump and reservoir of the flushing system. This universal adapter element is provided with appropriate O-rings for sealingly coupling to the oil filter port. This bayonet type of connection is simpler and more economical to manufacture, since it does not involve the fabrication of internal threads. Moreover, various adapter plates and sleeves which are already available in the prior art can be used to advantage with this type of oil filter port coupling adapter assembly.

For use with replaceable cartridge filters, as opposed to the "spin-on" type, I also provide an extender rod for use with the assembly in facilitating the connection of the universal coupling member in sealing relation with the filter housing.

The system of the invention has threaded oil pan adapters sized to fit within the drain port of the oil pan. These adapters will allow threaded connection to another connector, said connector being used with the majority of the oil pan adapters as a conduit through which fluid communication can be established between the oil pan and the flushing apparatus. Both oil pan adapters and connector are designed for minimal height to allow connection of the flushing apparatus in situations where space is limited.

The connector is capable of rotating completely (360°) on the oil pan adapter, thereby facilitating easy connection of the conduit attaching the connector to the flushing apparatus. This eliminates stress (unnecessary bending) on the connector/conduit itself, thereby extending its utility.

My design of oil filter adapter for some canister oil filter-equipped engines employs a cap through which fluid can be passed to the crankcase by the flushing apparatus. This cap incorporates a "bayonet" design that mates with a counterpart for retentive engagement. This counterpart includes an internal recess to which a post is attached, the other end of the post being threaded for connection to the oil filter port. The counterpart is bored through to allow fluid to pass from the top of the cap (via coupling to flushing apparatus) to the canister housing. Rotating the cap compresses the seal against the housing to provide a fluid tight connection.

Figure 6B:
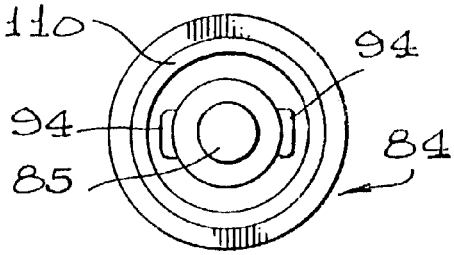
Figure 7B:
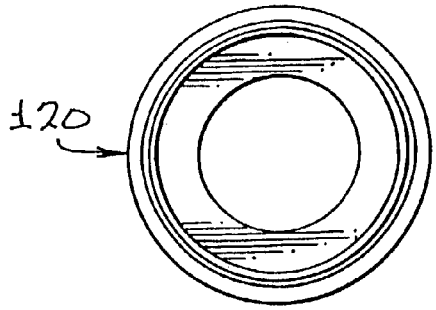
Figure 6A:
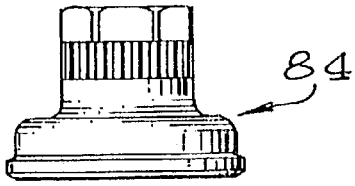
Figure 7A:
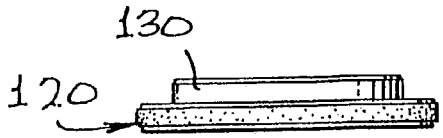
Figure 5:
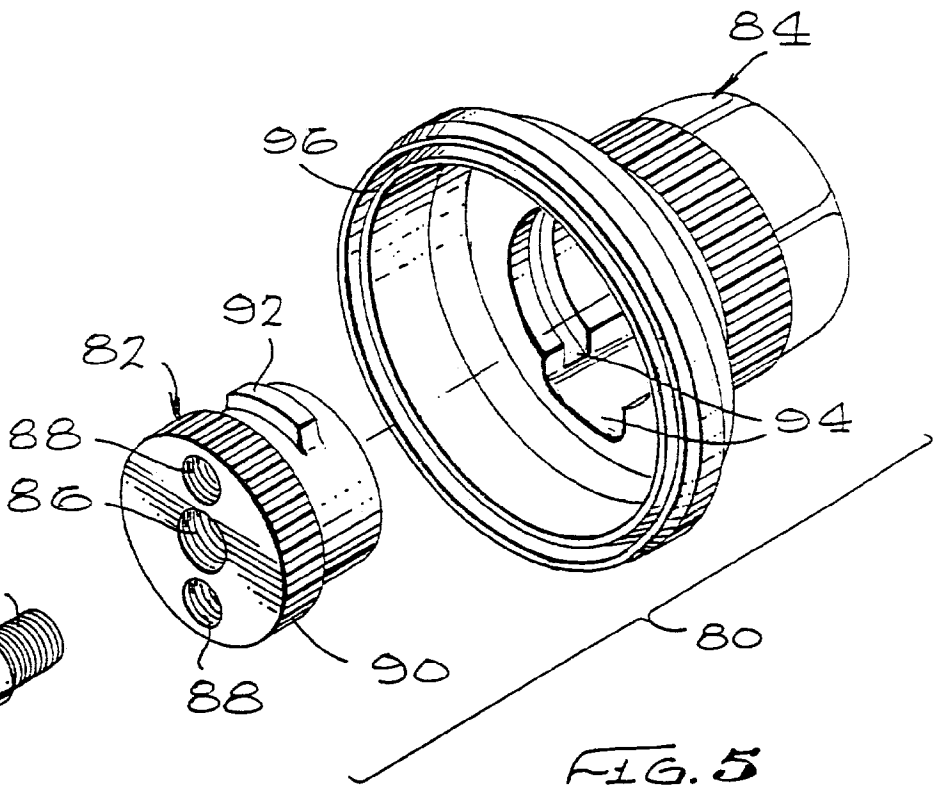
FIG. 5 is an exploded view of the second adapter assembly provided for coupling to the oil filter base plate of an engine.
Figure 8B:
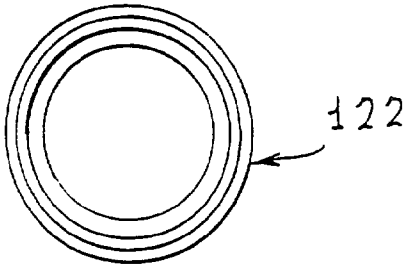
Figure 8A:
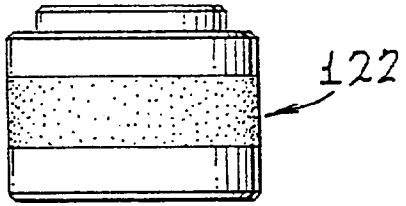
Figure 9:
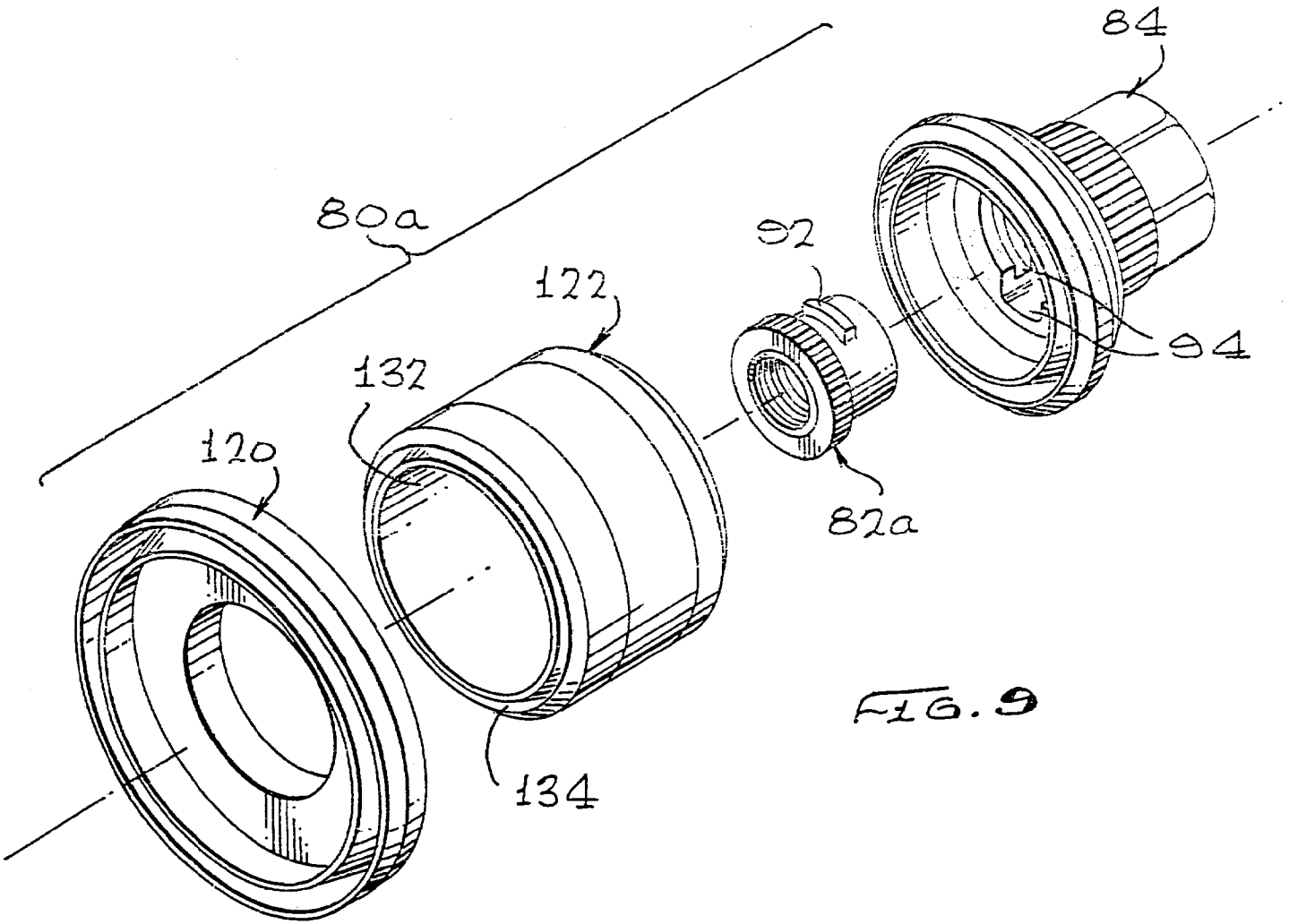

FIGS. 6, A and B, are respectively side elevations and bottom views of the adapter assembly of FIG. 5;

FIGS. 7, A and B, are respectively side and bottom views of one particular adapter element for use with the assembly of FIG. 6;

FIGS. 8, A and B, are respectively side and bottom views of another particular adapter for use with the assembly of FIG. 6; and FIG. 9 is an exploded view of an overall assembly incorporating the components of FIGS. 5, 6, 7 and 8.

Figure 1:
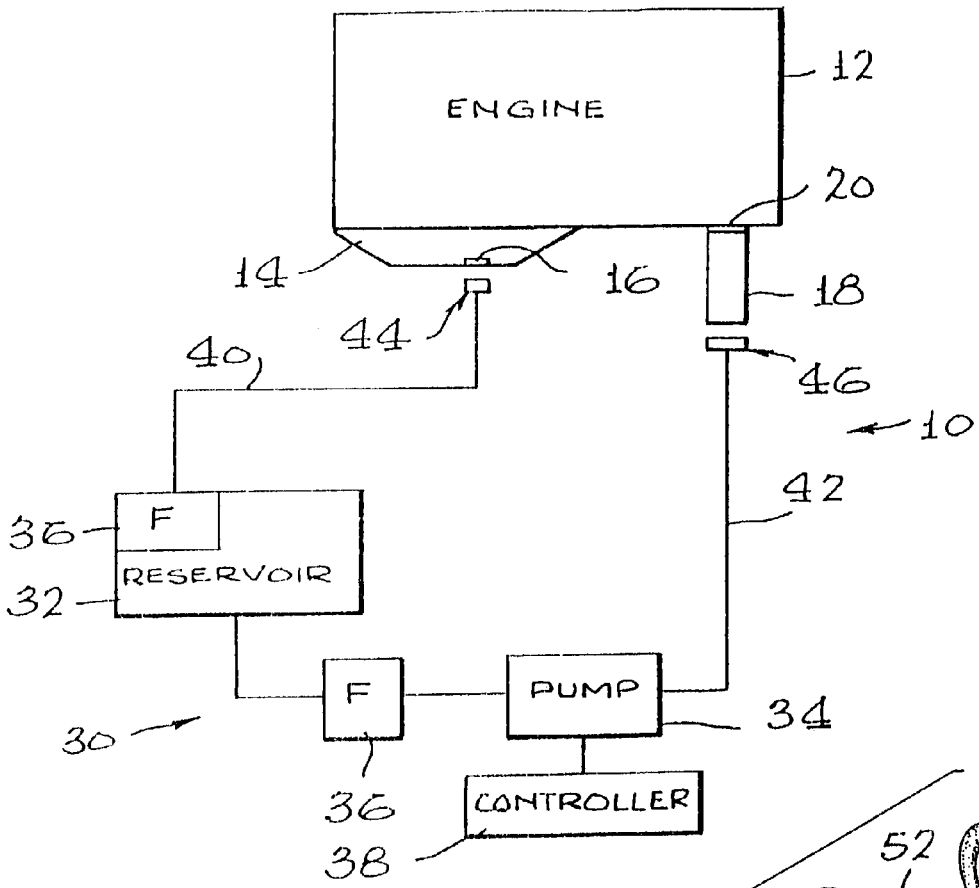
FIG. 1 is a schematic block diagram representing an engine flushing system in accordance with the present invention.

The block diagram of FIG. 1 represents engine flushing system 10 and shows an engine 12 with an oil pan 14 having a drain plug port 16 and an oil filter 18 mounted on a base plate 20. Filter 18 is removed in order to couple the flushing apparatus to the engine, as is also the drain plug which would be mounted in the drain plug port 16.

The flushing apparatus 30 is shown comprising a reservoir 32 for the cleaning solution to be used, a pump 34, filters such as 36, a pump controller 38 and various conduits 40, 42. The suction side conduit 40 terminates in a first adapter assembly 44 for coupling to the drain plug port 16. The pressure side conduit 42 terminates in a second adapter assembly 46 for coupling to the engine at the oil filter port(s).

Figure 2:
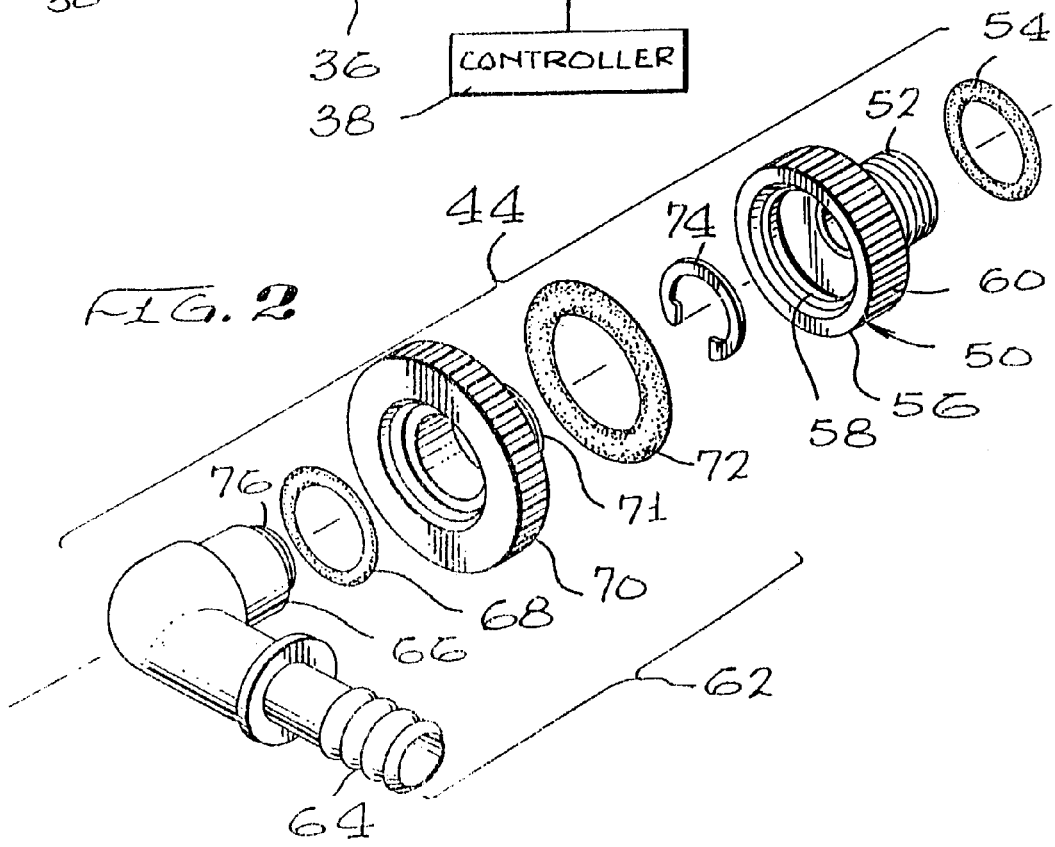
FIG. 2 is an exploded view of a first adapter assembly in the system of FIG. 1 for attachment to the oil pan drain port of an engine.
Figure 3:
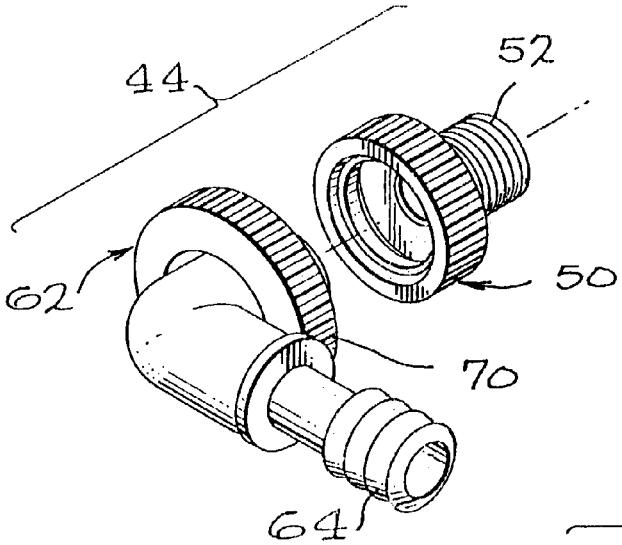
FIG. 3 is a schematic perspective view illustrating the pieces of FIG. 2 as assembled in the two distinct components of the first adapter assembly.
Figure 4:
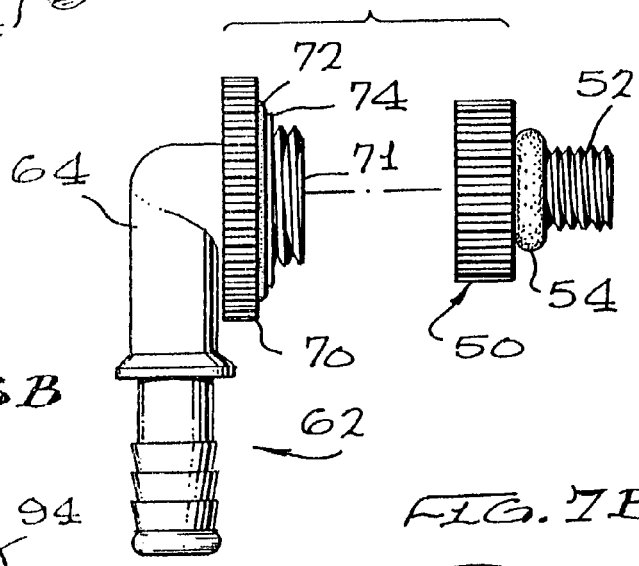
FIG. 4 is a schematic plan view of the two distinct components of the first adapter assembly.

Details of the first adapter are shown in FIGS. 2, 3 and 4, FIG. 2 being an exploded view. It comprises a threaded member 50 having external threads 52 about a reduced diameter portion, over which an O-ring 54 is mounted, and a larger diameter portion 56 having internal threads 58. The larger diameter section 60 is knurled about its outer circumference.

The universal fitting member 62 is configured to receive a right angle barb fitting 64 which has a shoulder 66 for mounting an O-ring 68 prior to its being inserted into the bore of a rotatable piece 70 having a knurled outer circumference. On the far side of the rotatable piece 70, not visible in FIG. 3, is another O-ring 72. As the piece 64 is joined into the piece 70 and extends through the O-ring 72, it is retained by a spring clip 74 fitting within a circumferential groove 76. FIG. 4 shows the threaded end 71 of the member 70 which, upon assembly, is threaded into the threads 58 of the specialized adapter element 50.

The second adapter assembly for coupling to the oil filter ports is illustrated in FIGS. 5–9, some of which show various adapter elements for accommodating different styles, sizes and configurations of oil filter coupling units. FIG. 5 shows the two pieces making up the basic oil filter port adapter assembly 80. This comprises a specialized fitting 82 and a universal fitting 84. The specialized fitting 82 has a central bore 86 which is threaded and sized to accommodate oil filter attachment of the particular automobile engine to be flushed. The system includes an inventory of these specialized fittings 82. In addition to the threaded bore 86, the fitting 82 is equipped with a pair of ports 88 for conducting the cleaning solution into the engine oil filter port. It also has knurled wheel section 90 for ease of threading onto the stem in the oil filter base plate. On the other side, remote from the face containing the ports 88, is shown one of a pair of bayonet lugs 92. These mate with corresponding recesses and recessed surfaces 94 within the universal fitting 84 so that the two pieces engage firmly when coupled together. The universal fitting 84 has a central bore 85 (FIG. 6B) for coupling to the pressure side conduit 42 of the flushing apparatus 30. An O-ring 96 is shown in the universal fitting 84 for providing an effective seal against the surface of the oil filter base plate.

Figure 5A:
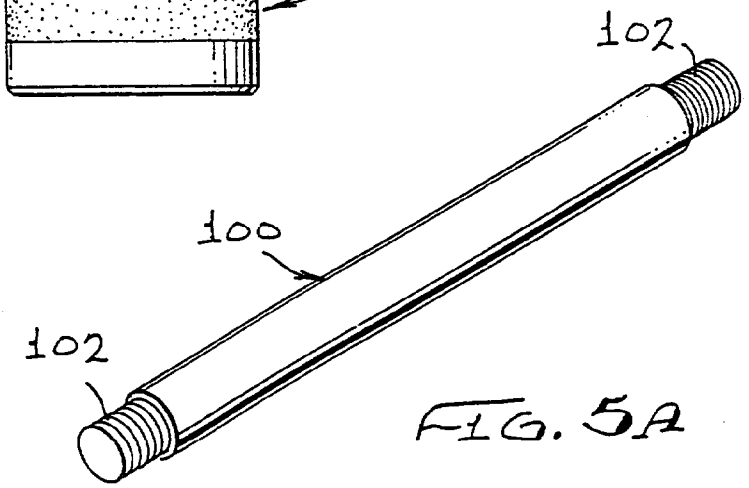
FIG. 5A is an adapter rod for use with the adapter assembly of FIG. 5 as may be needed for coupling to some oil filter ports.

Some filters such as, for example, cartridge filters have a long bolt which secures the cap to the housing of the filter. A corresponding adapter rod 100, threaded at both ends 102 and 104, is shown in FIG. 5A for use with the assembly of FIG. 5, where needed.

Other adapter assemblies are shown in FIGS. 6 through 9. FIGS. 6, A and B, show the universal fitting 84 of FIG. 5 in elevation and plan views, respectively. FIG. 6B also shows a circular groove 110 for receiving an O-ring to perfect the seal against the base plate or against any spacer members like those of FIGS. 7 and 8, where employed.

A relatively thin spacer member 120 is shown in the views A and B of FIG. 7. A longer spacer 122 is shown in the views A and B of FIG. 8. These may be employed as indicated in the exploded view of FIG. 9, the spacer 120 having a lower surface with a circumferential O-ring for sealing against the oil filter base plate and a reduced diameter, slightly extending, upper surface 130 which fits into the interior 132 of the spacer 122. The spacer 122 is also equipped with a slot 134 for receiving an O-ring to complete the seal against the adjacent surface of the spacer 120. Note that the specialized fitting 82*a* has a different size and thread from the specialized fitting 82 of FIG. 5. This is equipped to engage the corresponding stem of the oil filter base plate with which this adapter assembly 80*a* of FIG. 9 is used. Regardless of the configuration of the oil filter coupling to which the second adapter assembly of FIG. 9 is to be coupled, the universal adapter member 84 attaches with a bayonet coupling, as illustrated, comprising the lugs 92 and engagement surfaces 94.

Although there have been described hereinabove various specific arrangements of an IC ENGINE FLUSHING SYSTEM WITH SPECIALIZED ADAPTERS FOR COUPLING THE SYSTEM TO DIFFERENT OIL FLOW PORTS OF THE ENGINE in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the annexed claims.

What is claimed is:

1. An engine flushing system for flushing the lubricating oil passages of an internal combustion engine by coupling a flushing apparatus having a pressure conduit and a return conduit to respective engine inlet and outlet ports which communicate with said lubricating oil passages, said engine flushing system comprising:

flushing apparatus comprising a pump, a reservoir for containing cleaning solution and at least one filtration device for removing sludge and other contaminants from the cleaning solution after it is circulated through the lubricating oil passages of the engine;

a first adapter assembly for coupling the return conduit to said engine outlet port; and a second adapter assembly for coupling the pressure conduit to said engine inlet port;

each of said first and second adapter assemblies having:

a specialized fitting including a specialized coupling portion having a thread which is selected to mate with a corresponding one of said engine ports and a universal coupling portion which is adapted to engage a coupling member connected to a corresponding one of said flushing apparatus conduits; and a universal fitting having a universal coupling portion which is adapted to mate with the universal coupling portion of the corresponding specialized fitting for connecting together in fluid communication the specialized fitting and the corresponding flushing apparatus conduit.

2. The system of claim 1 wherein said specialized fittings are part of a kit which includes a plurality of specialized fittings fabricated to respectively fit all of the various automobile engines known.

3. The system of claim 1 wherein said flushing apparatus further comprises a controller coupled to the pump for causing the pump to operate in accordance with functional commands supplied to the controller.

4. The system of claim 3 wherein said at least one filtration device comprises a filter coupled in series with the fluid conduits of the flushing apparatus.

5. The apparatus of claim 1 wherein said first adapter assembly comprises a specialized fitting having a threaded portion which mates with the threaded opening in the drain plug port of the engine for which it is specified.

6. The system of claim 5 wherein the specialized fittings for the first adapter assembly are each provided with an internal threaded bore adapted to accept a universal fitting for coupling to the return conduit of the flushing apparatus.

7. The system of claim 1 wherein the second adapter assembly includes a specialized fitting having a specialized coupling portion adapted to matingly engage the inlet port of a specified internal combustion engine.

8. The system of claim 7 wherein said inlet port comprises the engine oil filter mounting assembly.

9. The system of claim 8 wherein the second adapter assembly includes mating bayonet coupling members configured to releasably lock said members together.

10. The system of claim 9 wherein said universal fitting of the second adapter assembly includes a circumferential O-ring for mounting said universal fitting in sealing relationship with the oil filter base plate.

11. The system of claim 10 wherein the second adapter assembly further includes a cylindrical spacer member having a transverse flat surface for providing a fluid seal with the O-ring of the universal member, the spacer member further including a circumferential O-ring in the face remote from said transverse flat surface to establish a fluid seal against the oil filter base plate.

12. The system of claim 1 wherein said specialized fitting of said first adapter assembly comprises a first threaded member having a reduced diameter portion with external threads sized to be threaded into the crankcase drain plug port of a vehicle to which it is especially adapted and a larger diameter portion having an internally threaded bore which is sized to matingly receive said universal fitting in threadably engaged, sealed communication.

13. The system of claim 12 wherein said universal fitting is configured to receive a right-angle barb fitting having a circumferential portion for mounting an adjacent O-ring, said circumferential portion being retained within a rotatable member by a spring clip installed within a circumferential groove of the right-angle barb fitting.

14. The system of claim 13 wherein said rotatable member includes an extending portion having external threads which are sized to matingly engage the internally threaded bore of the specialized fitting.

15. The system of claim 14 wherein said rotatable member has a circumferential groove within the face of said member next to said extending, externally threaded portion for mounting an O-ring to seal the coupling with said specialized fitting.

16. For use in an engine flushing system for flushing the lubricating oil passages of an internal combustion engine by coupling a flushing apparatus having a pressure conduit and a return conduit to respective engine inlet and outlet ports which communicate with said lubricating oil passages, a first adapter assembly including:

coupling means for coupling the return conduit to said engine outlet port, which coupling means comprise:

a specialized fitting including a first threaded portion having a thread which is selected to mate with said engine outlet port and a second threaded portion which has a universal thread for coupling to the return conduit of said flushing apparatus; and a universal fitting having a universal thread portion adapted to mate with the universal thread portion of said specialized fitting for connecting together in fluid communication the specialized fitting and the flushing apparatus return conduit.

17. The adapter assembly of claim 16 wherein said specialized fitting of said coupling means comprises a first threaded member having a reduced diameter portion with external threads sized to be threaded into the crankcase drain plug port of a vehicle engine to which it is especially adapted and a larger diameter portion having an internally threaded bore which is sized to matingly receive said universal fitting in threadably engaged, sealed communication.

18. The adapter assembly of claim 17 wherein said universal member is configured to receive an angled barb fitting having a circumferential portion for mounting an adjacent O-ring, said circumferential portion being retained within a rotatable member by a spring clip installed within a circumferential groove of the angled barb fitting.

19. The adapter assembly of claim 18 wherein said rotatable member includes an extending portion having external threads which are sized to matingly engage the internally threaded bore of the specialized fitting.

20. The adapter assembly of claim 19 wherein said rotatable member has a circumferential groove within the face of said member next to said extending, externally threaded portion for mounting an O-ring to seal the coupling with said specialized fitting.

21. The adapter assembly of claim 16 wherein said coupling means comprise a specialized fitting having a threaded portion which mates with the threaded opening in the drain plug port of the engine for which it is specified.

22. The adapter assembly of claim 21 wherein said specialized fitting is part of a kit which includes a plurality of specialized fittings fabricated to respectively fit all of the various automobile engines known.

23. The adapter assembly of claim 22 wherein each of said specialized fittings is provided with an internal threaded bore adapted to accept a universal fitting for coupling to the return conduit of the flushing apparatus.

24. For use in an engine flushing system for flushing the lubricating oil passages of an internal combustion engine by coupling a flushing apparatus having a pressure conduit and a return conduit to respective engine inlet and outlet ports which communicate with said lubricating oil passages, a second adapter assembly including:

coupling means for coupling the pressure conduit to said engine inlet port, which coupling means comprise;

a specialized fitting including a first threaded portion having a thread which is specialized to mate with said engine inlet port and a universal coupling portion including a universal bayonet connector portion for coupling to the pressure conduit of said flushing apparatus; and a universal fitting having a universal bayonet connector portion adapted to connect to the bayonet connector portion of said specialized fitting for connecting together in fluid communication the specialized fitting and the flushing apparatus pressure conduit.

25. The second adapter assembly of claim 24 wherein said specialized fitting has a coupling portion adapted to matingly engage the inlet port of a specified internal combustion engine.

26. The second adapter assembly of claim 25 wherein said inlet port comprises the engine oil filter mounting assembly.

27. The second adapter assembly of claim 26 wherein the universal bayonet connector portions are configured to releasably lock said fittings together.

28. The second adapter assembly of claim 27 wherein said universal fitting includes a circumferential O-ring for mounting said universal fitting in sealing relationship with the oil filter base plate.

29. The second adapter assembly of claim 28 further including a cylindrical spacer member having a transverse flat surface for providing a fluid seal with the O-ring of the universal fitting, the spacer member further including a circumferential O-ring in the face remote from said transverse flat surface to establish a fluid seal against the oil filter base plate.

* * * * *